US008453900B1

(12) United States Patent
Shirk

(10) Patent No.: US 8,453,900 B1
(45) Date of Patent: Jun. 4, 2013

(54) ROLLING STAPLE GUN

(76) Inventor: J. Randy Shirk, Denver, PA (US)

( * ) Notice: Subject to any disclaimer, the term of this patent is extended or adjusted under 35 U.S.C. 154(b) by 481 days.

(21) Appl. No.: 12/727,428

(22) Filed: Mar. 19, 2010

Related U.S. Application Data

(60) Provisional application No. 61/210,424, filed on Mar. 19, 2009.

(51) Int. Cl.
*B27F 7/02* (2006.01)

(52) U.S. Cl.
USPC ..... 227/7; 227/111; 227/138; 227/140

(58) Field of Classification Search
USPC ..... 227/6, 7, 110, 111, 138, 107, 140
See application file for complete search history.

(56) References Cited

U.S. PATENT DOCUMENTS

| | | | | |
|---|---|---|---|---|
| 2,915,754 | A * | 12/1959 | Wandel | 227/5 |
| 3,173,593 | A * | 3/1965 | Elliott | 227/111 |
| 3,796,365 | A * | 3/1974 | Downing | 227/8 |
| 3,984,040 | A * | 10/1976 | Fry | 227/7 |
| 4,119,258 | A | 10/1978 | Ewig, Jr. | |
| 4,225,074 | A * | 9/1980 | Jacobson | 227/2 |
| 4,657,167 | A * | 4/1987 | Mays | 227/99 |
| 4,732,307 | A * | 3/1988 | Hubbard et al. | 227/7 |
| 5,042,142 | A * | 8/1991 | Beach et al. | 29/787 |
| 5,067,865 | A | 11/1991 | Zylka et al. | |
| 5,125,552 | A * | 6/1992 | Medwed | 227/156 |
| 5,165,587 | A | 11/1992 | Marks | |
| 5,184,752 | A | 2/1993 | Zylka et al. | |
| D333,601 | S | 3/1993 | Wingert | |
| 5,556,080 | A | 9/1996 | Vise | |
| 5,699,949 | A | 12/1997 | Marks | |
| 5,749,508 | A * | 5/1998 | Clothier | 227/7 |
| 5,934,504 | A | 8/1999 | Elliott | |
| 6,064,189 | A * | 5/2000 | Frankel | 324/67 |
| 6,145,728 | A | 11/2000 | Marks | |
| 6,269,996 | B1 * | 8/2001 | McAllister | 227/7 |
| D466,773 | S | 12/2002 | Lin | |
| 6,736,303 | B2 * | 5/2004 | Bruins et al. | 227/99 |
| 6,755,334 | B2 * | 6/2004 | Ballent, Jr. | 227/2 |
| 6,913,180 | B2 | 7/2005 | Schuster | |
| D552,951 | S | 10/2007 | Shor | |
| 7,419,078 | B2 * | 9/2008 | Hamar | 227/111 |

* cited by examiner

*Primary Examiner* — Scott A. Smith
(74) *Attorney, Agent, or Firm* — Montgomery Patent & Design; Robert C. Montgomery

(57) ABSTRACT

A wheeled stapling apparatus which automatically staples various materials such as felt paper and rolled roofing as it is rolled across a surface is herein disclosed. The apparatus comprises an adjustable handle allowing the user to walk behind as the apparatus is rolled upon a horizontal or sloped surface. The stapling action is activated by a trigger located at the upper portion of the handle. The apparatus drives the staples into the surface at user selected distance intervals, set using a selector knob on the top of the apparatus body. The apparatus is powered by an easily replaceable rechargeable battery.

8 Claims, 7 Drawing Sheets

ROLLING STAPLE GUN

RELATED APPLICATIONS

The present invention was first described in and claims the benefit of U.S. Provisional Application No. 61/210,424 filed Mar. 19, 2009, the entire disclosures of which are incorporated herein by reference.

FIELD OF THE INVENTION

The present invention relates generally to staple guns, and in particular, to a device adapted for the quick, ergonomic, and automatically spaced placement of staples into a floor surface.

BACKGROUND OF THE INVENTION

Staples are utilized in a variety of applications, from common residential and commercial settings to a variety of larger versions suited for construction applications including roofing felt, installing underlayment, carpet padding, carpeting vapor barrier, building wrap, and the like. Many variations exist which are adapted for use in such construction applications and other large projects where the repeated and forceful placement of staples is required. While such devices incorporate features such as increased torque, pneumatic and electrically operated driving mechanisms, improved gripping means, and the like, the stress and strain of repeated operation of the staplers is taxing on both the equipment and the operator.

Various attempts have been made to provide staple guns. Examples of these attempts can be seen by reference to several U.S. patents. U.S. Pat. No. 5,165,587, issued in the name of Marks, describes a spring-actuated manual staple gun.

U.S. Pat. No. 4,284,223, issued in the name of Salcido et al., describes a pneumatic stapling gun adapted for easily stapling materials to a ceiling surface.

While these devices fulfill their respective, particular objectives, each of these references suffer from one (1) or more of the aforementioned disadvantages. Many such devices are strenuous on a user during repeated use over an extended period of time. Also, many such devices still allow for a great deal of operator error during placement. Furthermore, many such devices are not particularly adapted for use in stapling material in place on common ground surfaces. Accordingly, there exists a need for a staple gun without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a staple gun which allows a user to quickly and evenly place staples along a ground surface in a manner which is accurate and comfortable. Thus, the object of the present invention is to solve the aforementioned disadvantages and provide for this need.

To achieve the above objectives, it is an object of the present invention to comprise a rolling staple gun which provides a means to apply staples in to a ground surface in an automatic and intervallic manner. The apparatus comprises a handle assembly, a housing, and a battery charger base.

Another object of the present invention is to provide easy maneuvering of the apparatus across a workspace via the handle assembly. The handle assembly comprises three telescoping handle sections which provide a conventional length adjustment means. The handle sections extend upward at an angle and comprise an ergonomic handle at a distal end in order to provide a comfortable pushing means to a user.

Yet still another object of the present invention is to allow a user to easily actuate the stapler via a trigger located on the handle.

Yet still another object of the present invention is to provide power to the apparatus via a plug-in rechargeable battery which is recharged using the battery charger base, similar to conventional power tools and the like. The battery charger base provides easy recharging via a conventional wall outlet.

Yet still another object of the present invention is to provide a protective mounting and enclosing means to the electromechanical components of the apparatus via the housing. The housing contains the components which drive staples into a subjacent ground surface.

Yet still another object of the present invention is to further comprise the housing of ergonomic and protective features such as an access panel, a potentiometer, wheels, and a front bumper.

Yet still another object of the present invention is to provide automatic stapling capabilities via a staple feeding assembly and a staple driving assembly located in the housing. The staple feeding assembly comprises conventional features such as rails, a slider, a coiled spring, and a size capable of storing a sufficient number of staples so as to minimize interruption of a project to replenish the staples.

Yet still another object of the present invention is to provide automatic stapling via the staple driving assembly, which comprises a control module, a pitch selection potentiometer, an encoder, a battery socket, and a solenoid actuator. The potentiometer provides a means of selectively setting the distance that the apparatus travels between stapling actions, with the distance measured via a rotary encoder affixed to an axle portion of one of the wheels. The trigger, potentiometer, and encoder provide signals to the control module which provides electronic activation of the solenoid actuator in order to drive staples in an equally-spaced linear pattern.

Yet still another object of the present invention is to provide quick and repeatable stapling actions via a piston and shaft assembly which comprises a spring and an inverting jack mechanism. The solenoid actuator comprises a common linear electro-magnetic device which initiates a horizontal movement of a portion of the jack mechanism, which is translated into downward motioning of a vertical portion of the jack mechanism. The spring returns the mechanism to its initial state between motions.

Yet still another object of the present invention is to provide a method of utilizing the device that provides a unique means of loading a desired size of staples into the apparatus via the access panel, selecting a desired distance between successive stapling actions via the potentiometer, providing easy and accurate motion of the apparatus via the handle assembly and wheels, and providing selective actuating of the stapling driving assembly via the provided trigger.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
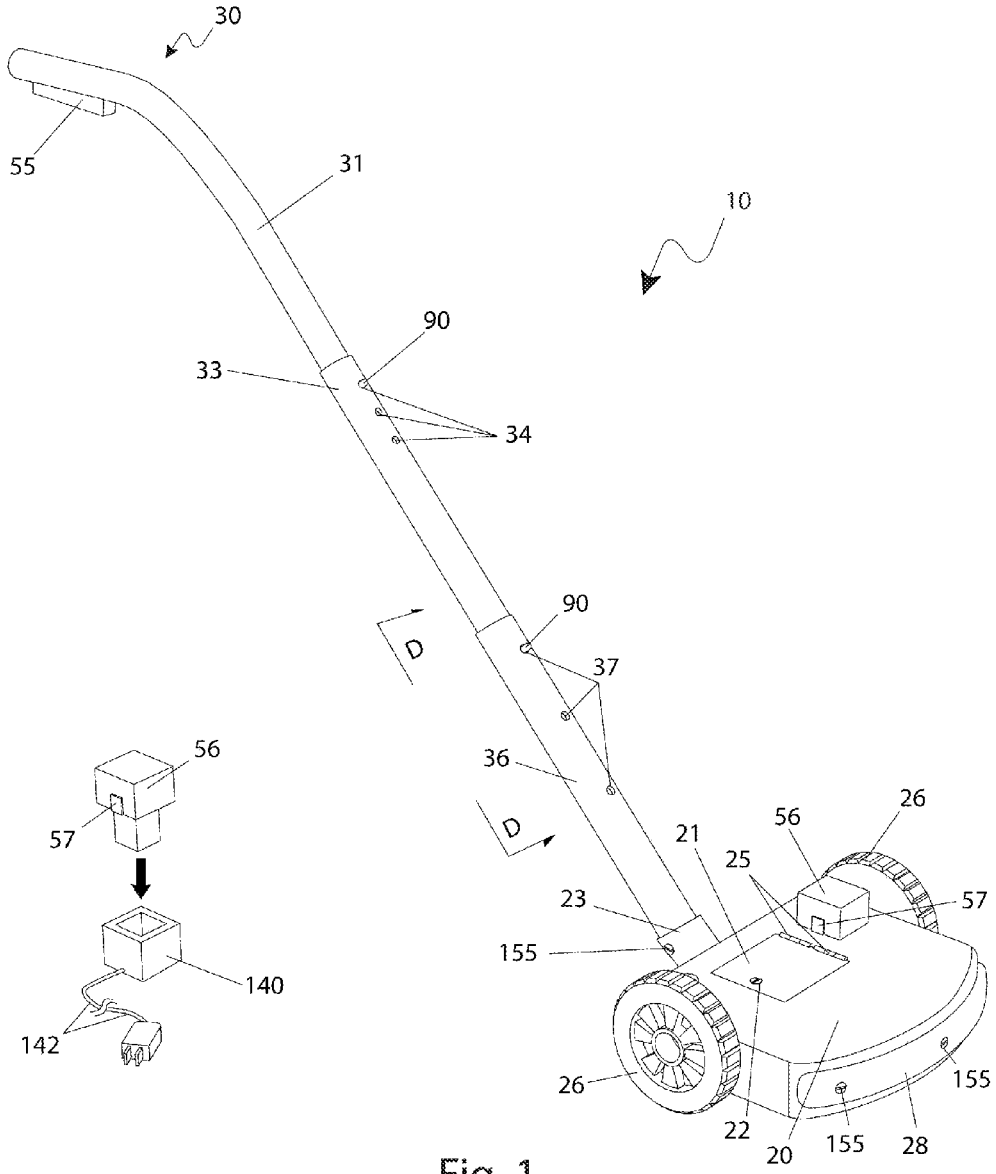
FIG. 1 is a perspective view of a rolling staple gun 10, according to a preferred embodiment of the present invention.

| DESCRIPTIVE KEY | |
|---|---|
| 10 | rolling staple gun |
| 20 | housing |
| 21 | access panel |
| 22 | latch |
| 23 | handle socket |
| 25 | hinge |
| 26 | rear wheel |
| 27 | axle |
| 28 | bumper |
| 30 | handle assembly |
| 31 | first handle section |
| 33 | second handle section |
| 34 | second handle aperture |
| 35 | spring pin |
| 36 | third handle section |
| 37 | third handle aperture |
| 40 | front wheel |
| 42 | front wheel axle |
| 44 | bearing |
| 50 | control module |
| 52 | pitch selection potentiometer |
| 54 | encoder |
| 55 | trigger |
| 56 | battery |
| 57 | battery latch |
| 58 | battery socket |
| 60 | wiring |
| 62 | solenoid actuator |
| 63 | mounting ear |
| 64 | solenoid piston/shaft |
| 70 | driving assembly |
| 72 | first tool |
| 73 | bearing block |
| 74 | second tool |
| 75 | driver frame |
| 77 | spring |
| 78 | collar |
| 80 | staple aperture |
| 90 | locking button |
| 92 | locking button spring |
| 94 | rivet |
| 96 | spring button aperture |
| 100 | staple feed assembly |
| 102 | rail |
| 104 | slider |
| 106 | coil spring |
| 108 | spring housing |
| 140 | battery charger base |

-continued

| DESCRIPTIVE KEY | |
|---|---|
| 142 | charger power cord |
| 150 | staple |
| 155 | fastener |
| 160 | working surface |

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a rolling staple gun (herein described as the "apparatus") 10, which provides a means to apply a plurality of staples 150 in an incremental succession in an automatic manner to a work surface 160 while motioning the apparatus 10 across said surface 160 using a convenient adjustable handle assembly 30. The apparatus 10 comprises a light-weight housing 20 which houses associated electro-mechanical components and a solenoid 62 powered staple gun device. The apparatus 10 automatically drives staples 150 in a linear pattern while providing a user-defined distance between successive staples 150 especially useful when utilized with various industrial stapling applications.

Referring now to FIG. 1, a perspective view of the apparatus 10, according to the preferred embodiment of the present invention, is disclosed. The apparatus 10 comprises a handle assembly 30, a housing 20, and a battery charger base 140. The telescoping tubular handle assembly 30 allows a user to easily maneuver the apparatus 10 across a work surface 160 such as a roof, floor, or the like. The handle assembly 30 comprises a first handle section 31, a second handle section 33, and a third handle section 36. Said handle sections 31, 33, 36 are capable of being inserted into each other in a telescoping manner via respective sequentially increasing inner diameter portions. Said handle sections 31, 33, 36 provide overall length adjustment of the handle assembly 30 and being locked into a desired overall length along a common axis via a plurality of apertures 34, 37 and a pair of pop-out locking spring pins 90 (see FIG. 6). The handle sections 31, 33, 36 are envisioned to be fabricated from tubular materials such as, but not limited to: metal, plastic, or the like. Each handle section 31, 33, 36 is approximately eighteen (18) inches in length and extends upward at approximately a forty-five degree (45°) angle. The first handle section 31 comprises a slightly curved end portion, thereby providing the apparatus 10 with an easily gripped ergonomic design. The first handle section 31 also comprises an electronic trigger 55 allowing a user to actuate the apparatus 10 to drive staples 150. The trigger 55 is located along a bottom surface of an upper end portion of the first handle section 31. The trigger 32 comprises a common electro-mechanical device such as, but not limited to: a push button, a rocker switch, slide switch, or the like. A bottom portion of the first handle section 31 further comprises an internal spring button 90 which mates with one (1) of a plurality of second handle apertures 34 positioned in an equally-spaced linear pattern thereon a top portion of the second handle section 33. In like manner, the second handle section 33 provides adjustable attachment to the third handle section 36 via another internal spring button device 90 located therein the bottom portion of the second handle portion 33, being engaged into one (1) of a plurality of third handle apertures 37 located at an upper portion of the third handle section 36. The third handle section 36 also provides an inserting attachment means to an integral handle socket portion 23 of the housing 20 being inserted into and secured using at least one (1) common fastener 155 such as a screw, bolt, rivet, or the like. Said handle socket portion 23 is integrally-molded into and protruding therefrom a rear central portion of the housing 20 approximately four (4) inches at an upward angle of approximately forty-five (45) degrees (see FIG. 3).

The apparatus 10 is powered using an easily replaced plug-in rechargeable battery 56 envisioned to be recharged using a remote battery charger base 140 in a similar manner as popular cordless power tools such as drills, saws, and the like. The battery charger base 140 provides conventional conversion of available 110-volt alternating current (AC) power into a battery charging direct current (DC). Said battery charger base 140 is envisioned to be plugged into an available duplex outlet utilizing a common charger power cord 142.

Figure 2:
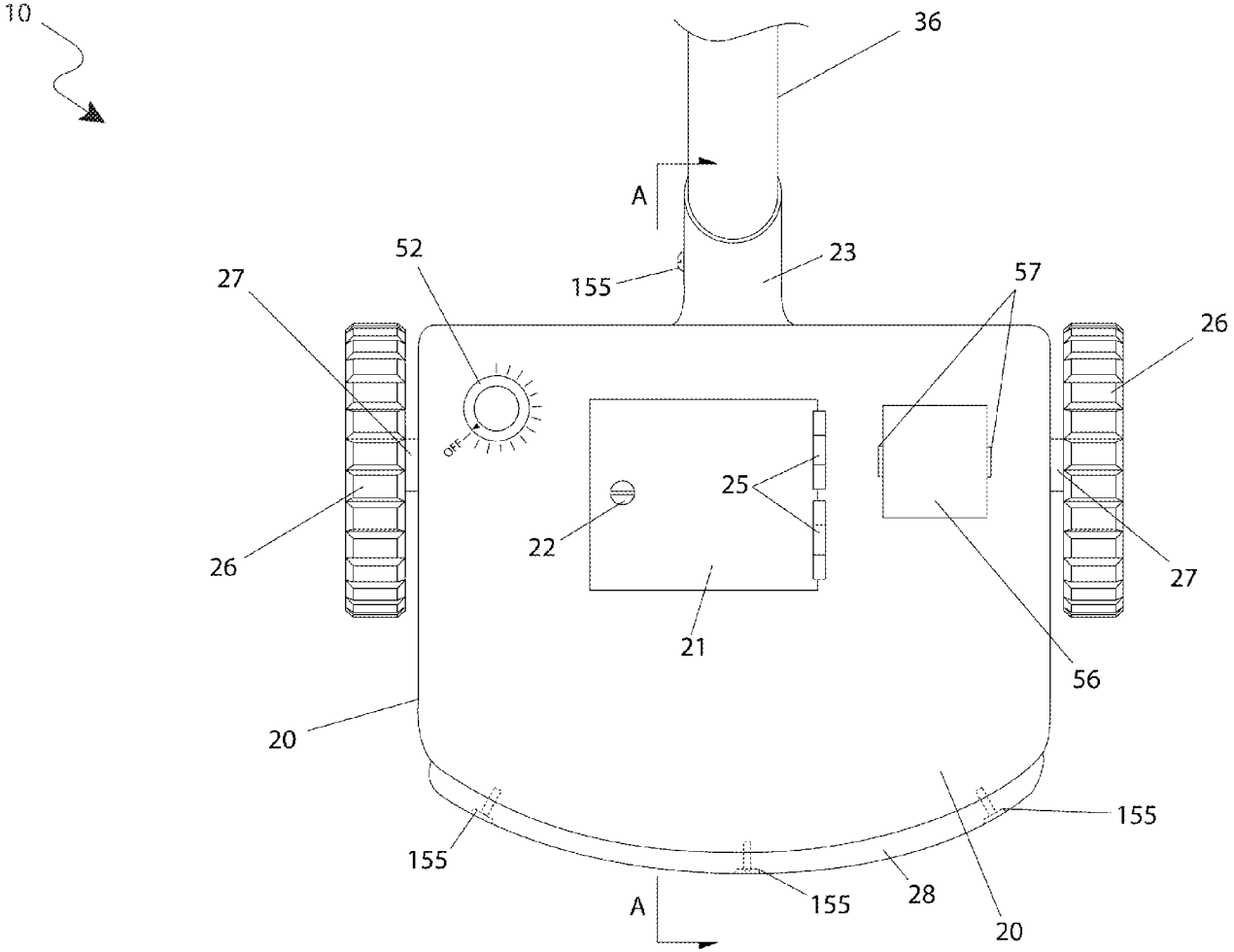
FIG. 2 is a top view of the rolling staple gun 10, according to a preferred embodiment of the present invention.

Referring now to FIG. 2, a top view of the apparatus 10, according to a preferred embodiment of the present invention, is disclosed. The apparatus 10 comprises a housing 20 which provides a mounting and enclosing means to associated electro-mechanical components necessary to drive staples 150 into the subjacent working surface 160. The housing 20 comprises a low-profile generally rectangular molded plastic enclosure having an arcuate front surface; however, it is understood that the housing portion 20 of the apparatus 10 may be provided having a variety of decorative shapes and designs without deviating from the concept and as such should not be interpreted as a limiting factor of the apparatus 10. The housing 20 further comprises an access panel 21, a pitch selection potentiometer 52, a pair of rear wheels 26, and a front bumper 28. The housing 20 is envisioned to be fabricated using rugged plastic materials similar to the handle 30 (see FIG. 1). The rear wheels 26 facilitate easy movement of the apparatus 10 while providing traction and stability during use. Each wheel 26 is envisioned to be made of plastic or rubber materials and measure approximately three (3) inches in diameter being affixed to opposite side portions of the housing 20 using respective axles 27. The housing 20 also comprises a forward facing bumper 28, thereby supplying the apparatus 10 protection from impact and possible damage. The bumper 28 extends laterally across a forward-facing vertical surface of the housing 20. Said bumper 28 is envisioned to be fabricated from materials such as, but not limited to: rubber, plastic, steel, or the like, and affixed to said housing 20 using a plurality of common fasteners 155. The housing 20 further comprises an access panel 21 centrally located along a top surface, thereby allowing access for servicing internal components of the apparatus 10. Said servicing may include replenishing a supply of staples 80 and/or maintaining other electro-mechanical components within the housing 20. The access panel 21 is envisioned to be made of similar materials as the aforementioned housing 20. The access panel 21 further comprises a common latch 22 and a pair of hinges 25 along an opposing edge to facilitate convenient opening and closing thereof.

Figure 4:
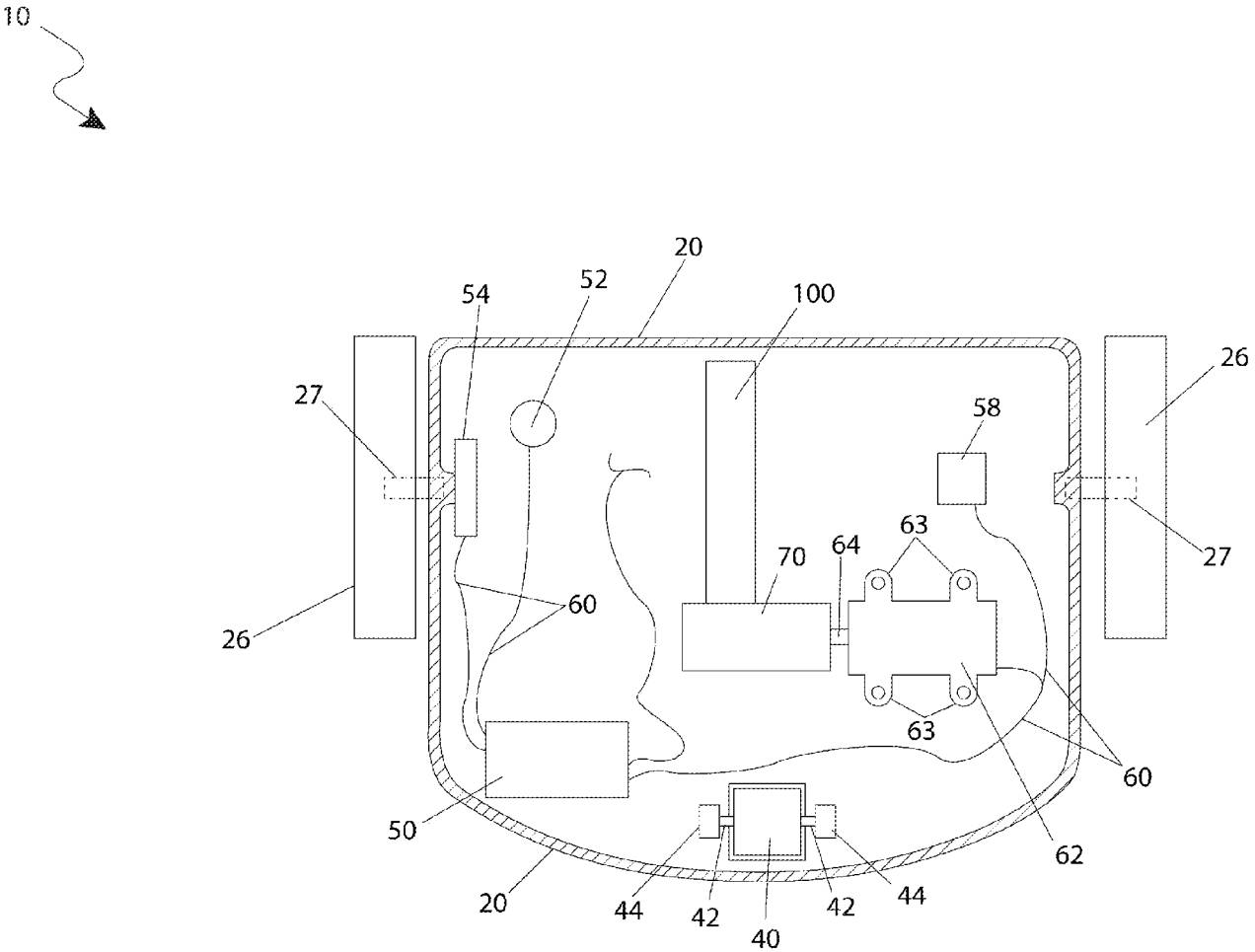
FIG. 4 is a section view of the rolling staple gun 10 taken along section line B-B (see FIG. 3), according to a preferred embodiment of the present invention.

The pitch selection potentiometer 52 provides a means for a user to select a particular distance between consecutive staples 150 to be driven into a work surface 160 (see FIG. 4).

The battery 56 provides an inserting attachment means to the housing 20 via a pair of locking battery latches 57 and a battery socket 58, thereby securing said battery 56 to the housing 20 in a similar manner as popular cordless power tools such as drills, saws, and the like. When latched to the housing 20, said battery 56 establishes electrical communication via the battery socket 58 being integral to said housing 20, thereby powering the major electrical components of the apparatus 10 housed within the housing 20 (see FIGS. 3 and 4).

Figure 3:
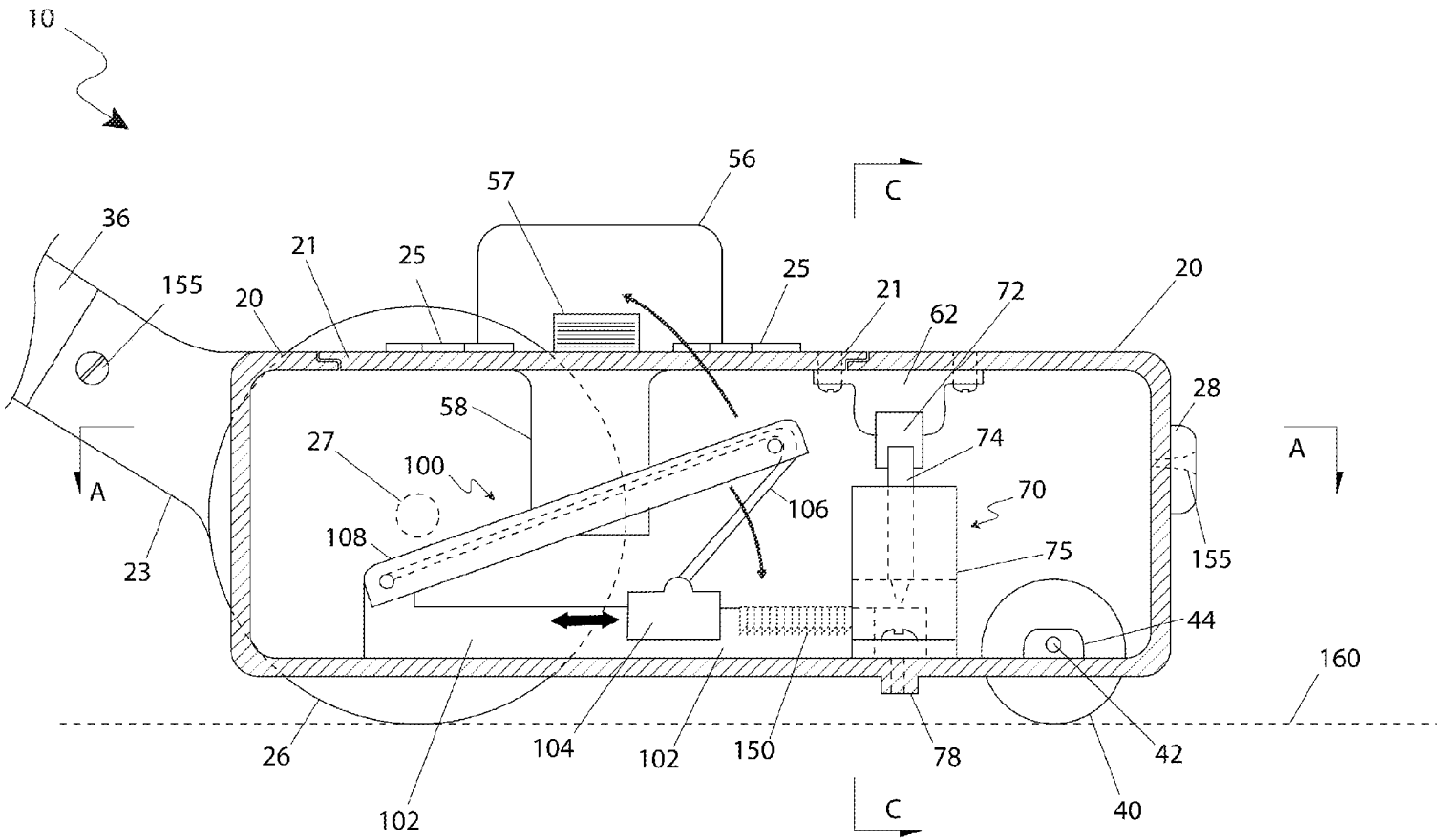
FIG. 3 is another section view of the rolling staple gun 10 taken along section line A-A (see FIG. 2), according to a preferred embodiment of the present invention.

Referring now to FIG. 3, another section view of the apparatus 10 taken along section line A-A (see FIG. 2), according to a preferred embodiment of the present invention, is disclosed. The apparatus 10 comprises a staple driving assembly 70 and a staple feed assembly 100. The staple feeding assembly 100 further comprises a rail 102, a slider 104, a coil spring 106, and a spring housing 108. The staple feeding assembly 100 is envisioned to provide linear spring-loaded motivation of at least one (1) strip of purchased bonded staples 150 along a rail portion 102 in a similar manner as conventional stapling units common in the industry. The rail 102 comprises a narrow elongated platform having a rectangular cross sectional shape approximately one-half (½) inch wide providing smooth sliding of said staples 150. Said rail 102 is to be capable of storing a sufficient number of staples 150 to minimize interruption of a project to replenish said staples 150. The slider 104 also slides along the rail 102 to provide a static pushing force against the staples 150 toward the staple driving assembly 70 so as to maintain a staple 150 in a "ready" position at all times during the stapling process (see FIG. 5). A motioning force is applied thereto the slider 104 and the staples 150, via the coil spring 106 being secured to said slider 104 and affixed to the pivoting spring housing 108. The spring housing 108 provides a means to access and replenish the staples 150 being pivotingly secured at a rear portion and pivoting upwardly to expose the rail 102 and release the slider 104 rearwardly, allowing a user to place at least one (1) strip of purchased staples 150 upon the rail 102.

The rail 102, slider 104, and spring housing 108 comprise particular width and height dimensions which correspond to standard styles and sizes of industrial staples 150; therefore, it is understood that the apparatus 10 is to be introduced in a plurality of models being specifically configured based upon said purchased staples 150 or groups of staple sizes, and as such should not be interpreted as a limiting factor of the apparatus 10.

Referring now to FIG. 4, a section view of the apparatus 10 taken along section line B-B (see FIG. 3), according to a preferred embodiment of the present invention, is disclosed. The apparatus 10 comprises internal components necessary to drive staples 150 in an accurate and controlled manner including a control module 50, a pitch selection potentiometer 52, an encoder 54, a battery socket 58, a solenoid actuator 62, a staple driving assembly 70, and a staple feed assembly 100. The apparatus 10 provides a means to drive staples 150 at a user selected distance therebetween along a working surface 160. A distance between said staples 150 is set by a user by rotating the pitch selection potentiometer 52 to a desired setting (see FIG. 2). Additionally, a distance that the apparatus 10 travels across said work surface 160 is continuously measured via a rotary encoder 54 affixed to an axle portion 27 of one (1) of the rear wheels 26. Input signals therefrom said pitch selection potentiometer 52 and encoder 54, along with an activation signal from the aforementioned trigger 55, are conducted to the control module 50 via internal wiring 60 which in turn provides accurate electronic activation of the solenoid actuator 62 to drive the staples 150 in an equally-spaced linear pattern (see FIG. 5). The control module 50 comprises a standard plastic enclosure containing necessary electrical and electronic equipment necessary to operate the staple driving function of the apparatus 10 such as, but not limited to: circuit boards, microprocessors, input/output (I/O) signal processing components, embedded software, relays, and the like.

Electric power is conducted to the control module 50, and subsequently thereto all major components of the apparatus 10, from the rechargeable battery 56 which is removably inserted into the battery socket 58 located within a top surface of the housing 20 (see FIG. 1).

The apparatus 10 also comprises a front wheel 40 which works in conjunction therewith the aforementioned rear wheels 26 to provide a three (3) point support means to the apparatus 10, thereby providing smooth stable motioning during application of staples 150. The front wheel 40 comprises a common cylindrical plastic or rubber member having a central horizontally extending metal axle and supportive molded-in bearings 44 being arranged at opposing side positions and being integrally-molded into a floor portion of the housing 20 (see FIG. 3).

Figure 5:
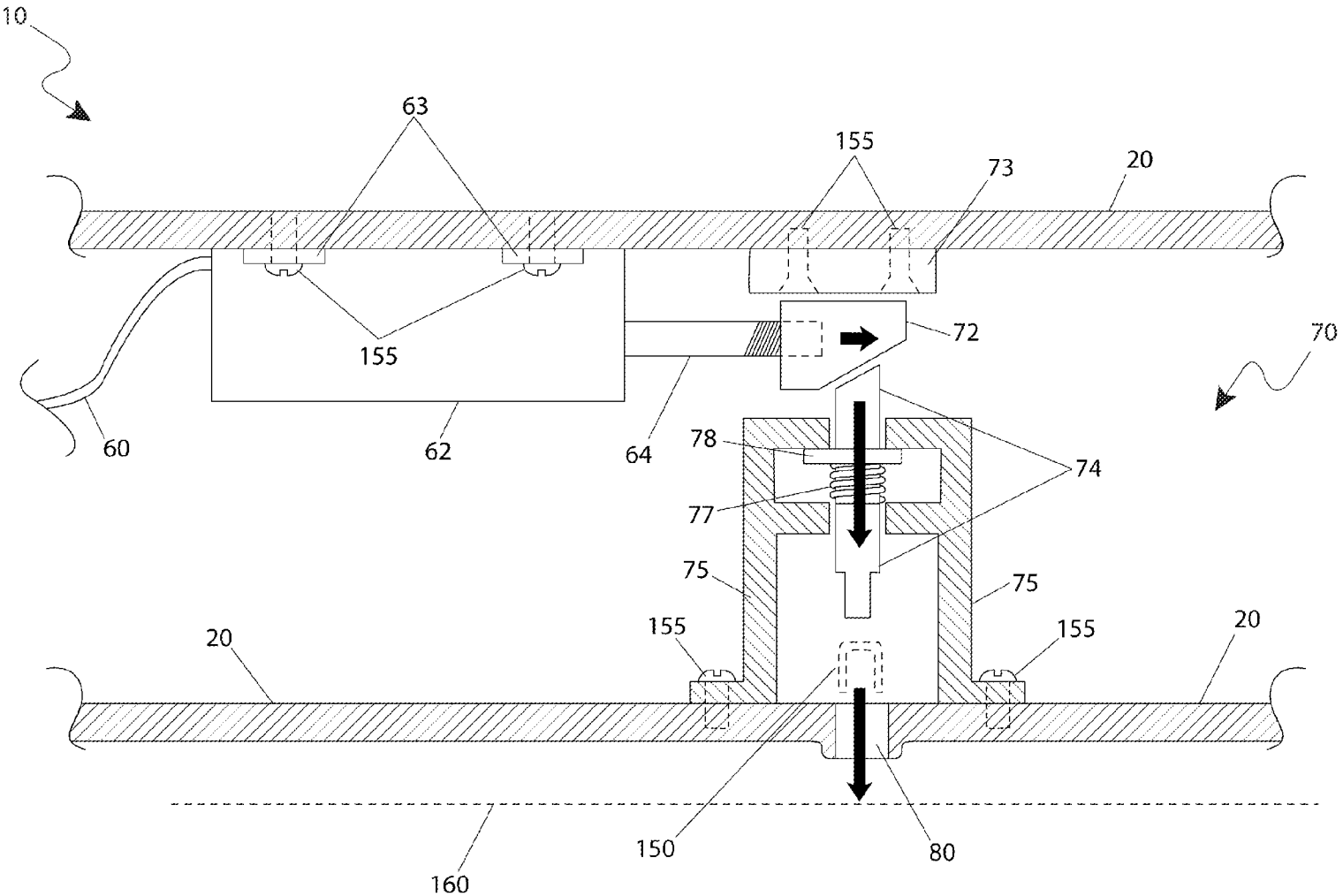
FIG. 5 is another section view of the staple driving assembly portion 70 of the rolling staple gun 10 taken along section line C-C (see FIG. 3), according to a preferred embodiment of the present invention.

Referring now to FIG. 5, another section view of the staple driving assembly portion 70 of the apparatus 10 taken along section line C-C (see FIG. 3), according to a preferred embodiment of the present invention, is disclosed. The staple driving assembly 70 comprises a solenoid actuator 62, a first tool 72, a second tool 74, a driver frame 75, a spring return mechanism 77, and a staple aperture 80. The solenoid 62 comprises a common linear electro-magnetic device comprising common mounting ears 63 and affixed to an underside surface of the housing 20 using common fasteners 155. The solenoid 62 further comprises a central driving piston/shaft 64 which upon receiving a momentary flow of current from the control module 50, propels the solenoid piston/shaft 64 and the threadingly attached first tool 72 forward in a horizontal direction. It is further envisioned that the piston/shaft 64 of the solenoid 62 provides a spring-return function.

The first tool 72 is guided along a horizontal plane via a bearing block 73 which slidingly contacts a top surface of the first tool 72 in a parallel manner, thereby absorbing torsional forces acting upon said first tool 72 during the staple driving process. Said bearing block is attached to an underside surface of the housing 20 using common fasteners 155. Said first tool 72 comprises an angular forward face which engages a similarly angled upper face portion of the second tool 74 being positioned at a right angle to said first tool 72. The second tool 74 is guided and restrained in a vertical orientation via the driver frame 75. The driver frame 75 provides a rugged platform to anchor and guide the second tool 74 and is also attached to the floor portion of the housing 20 using common fasteners 155. The sliding engagement of the angular faces of the first 72 and second 74 tools acts as a pair of sliding incline planes forming a simple inverted jacking mechanism to convert the horizontal force of the first tool 72 into a vertical force which acts upon the second tool 74, thereby propelling the second tool 74 downward. Said second tool 74 in turn drives a single staple 150 downwardly through the staple aperture 80 and into the work surface 160. The staple aperture 80 comprises a rectangular vertical opening through the bottom panel portion of the housing 20 being correspondingly sized with regards to the staple 150 so as to guide said staple 150 into said work surface 160. The driver frame 75 provides a spring return means to automatically return the second tool 74 to the upward "ready" position via a compression spring 77 which acts upon an integral collar portion 78 of the second tool 74.

However, it is understood that the apparatus 10 is not limited to the particular staple driving mechanism illustrated here and that various other simple mechanisms may be designed which provide equal functionality and as such should not be interpreted as a limiting factor of the apparatus 10.

Figure 6:
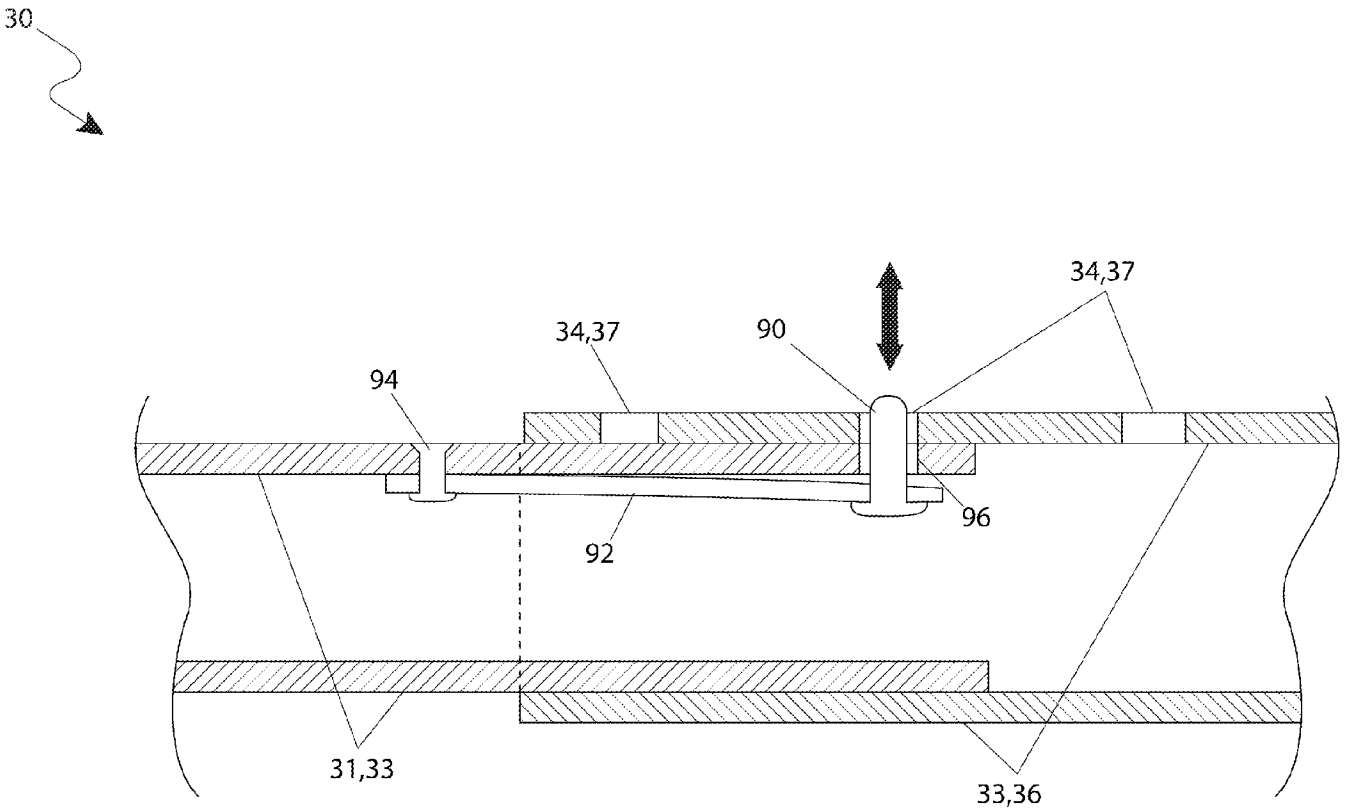
FIG. 6 is a section view of the handle assembly portion 30 of the rolling staple gun 10 taken along section line D-D (see FIG. 1), according to a preferred embodiment of the present invention; and, FIG. 7 is an electrical block diagram of the apparatus 10, according to the preferred embodiment of the present invention.

Referring now to FIG. 6, a section view of the handle assembly portion 30 taken along section line D-D (see FIG. 1), according to a preferred embodiment of the present invention, is disclosed. The handle assembly 30 provides a telescoping height adjustment means similar to those utilized on adjustable awnings, tent posts, and the like. The second 33 and third 36 handle sections comprise particular features to provide a length adjustable locking means including a plurality of second 34 and third 37 handle apertures, respectively. Said apertures 34, 37 are arranged in a linear and equidistant pattern along top surfaces of said sections 33, 36. Correspondingly, the first 31 and second 33 handle sections comprise common locking spring buttons 90 fastened along inner surfaces of said sections 31, 33 using a rivet 94. Each spring button 90 further comprises a locking button spring 92 and a spring button aperture 96 formed through an end portion of the respective handle sections 31, 33. A desired length of the handle assembly 30 may be selected by a user by manually depressing the spring buttons 90 inwardly allowing the inner handle sections 31, 33 to move freely in a telescoping manner. Upon alignment of said spring buttons 90 and desired handle apertures 34, 37, the spring buttons 90 are automatically motioned outwardly by the spring 92 through said handle apertures 34, 37 to secure the length of the handle assembly 30.

Figure 7:
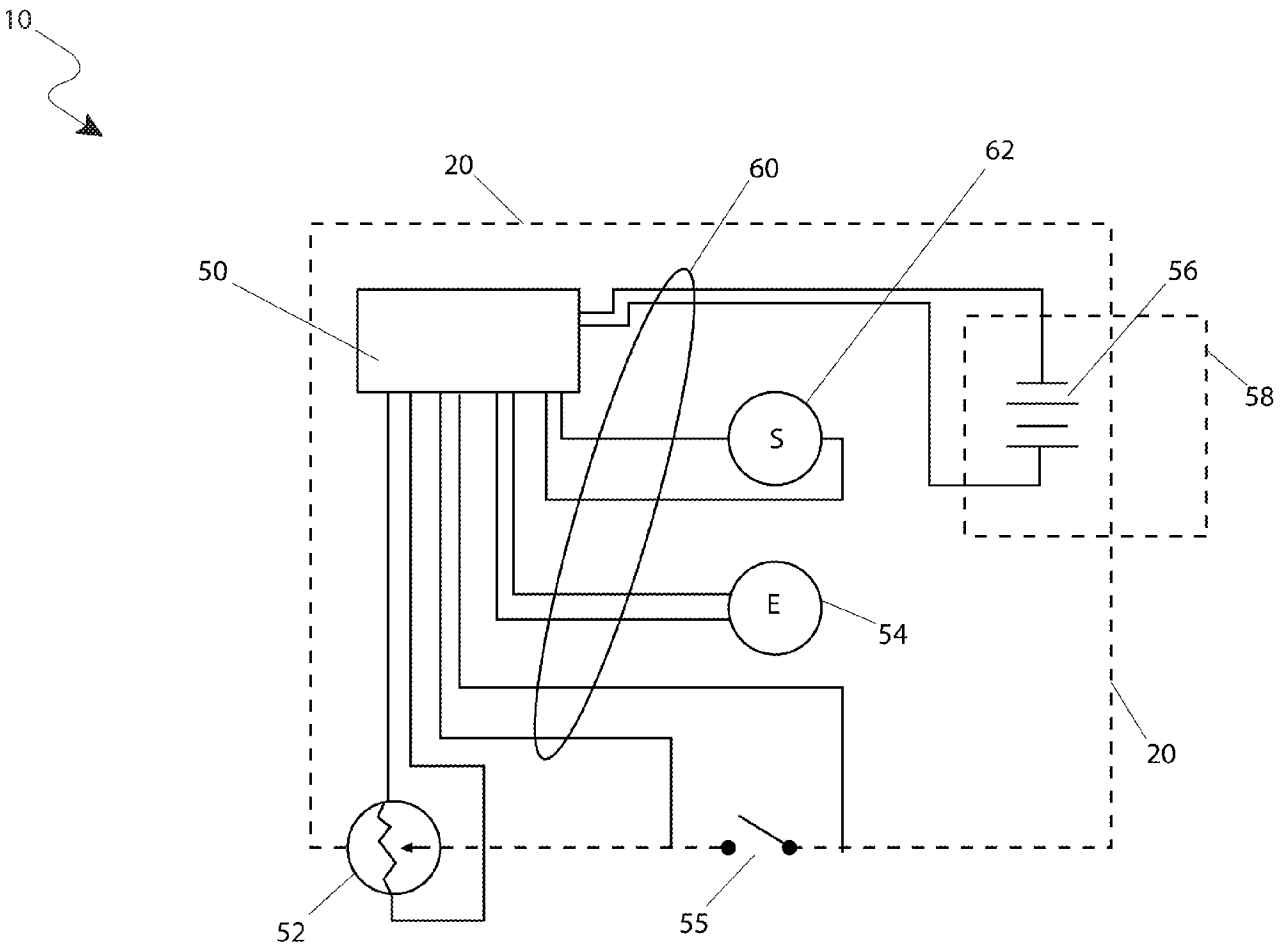

Referring now to FIG. 7, an electrical block diagram of the apparatus 10, according to the preferred embodiment of the present invention, is disclosed. The control module 50 is interconnected to and receives power from the battery 56 via common electrical wiring 60. The battery 56 comprises a rechargeable type cell similar to like units used with common cordless power tools.

The apparatus 10 comprises a pitch selection potentiometer 52 which enables the apparatus 10 to dispense the staples 150 at desired repeating intervals envisioned to be selectively variable from one (1) inch to two (2) feet. The pitch selection potentiometer 52 is preferably a common analog dial instrument being in electrical communication with the control module 50 via common wiring 60. Additionally, the encoder 54 provides signal data to said control module 50 representing a traveled distance as the rear wheels 26 are motioned across the work surface 160. Finally, the trigger 55 provides an enabling contact closure to the control module 50 to provide output power to the solenoid 62 as directed by the signals received from the pitch selection potentiometer 52 and encoder 54, and the software embedded within the control module 50. The control module 50 regulates current to the solenoid 62 at accurate intervals, thereby providing positional accuracy to the driven staples 150 at a desired pitch along the work surface 160.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 may be achieved by performing the following steps: acquiring a particular model or models of the apparatus 10 to drive a desired size staple 150; adjusting the handle assembly 30 to a desired height by pressing one (1) or more of the spring pins 90 to telescopingly adjust the extended length of the first 31 second 33, and third 36 handle sections thereto a desired length; releasing the spring pins 90 into corresponding apertures 34, 37 to secure the handle assembly 30 at said desired length; releasing the latch portion 22 of the access door 21 and lifting said access panel 21 to expose the staple feed assembly 100; pivoting the spring housing 108 upwardly to expose the rail 102; loading one (1) or more strips of staples 150 thereonto the rail 102; replacing the spring housing 108; closing the access panel 21 and securing the latch 22; adjusting the pitch selection potentiometer 52 thereto a desired setting based upon a particular stapling project; inserting a fully-charged battery 56 into the battery socket 58 until the two (2) battery latches 57 are fully engaged and locked; placing rear 26 and front 40 wheels of the apparatus 10 upon a work surface 160 being covered with materials such as felt paper, rolled roofing, or the like, to be stapled; depressing the trigger 55 to activate staple driving function of the apparatus 10; motioning the apparatus 10 across the work surface 160 along a stapling pattern by utilizing the handle assembly 30 and wheels 26, 40 to automatically drive staples 150 into said work surface 160; pressing the trigger 32 and motioning the apparatus 10 repeatedly as needed to complete a project; replacing and/or recharging the battery 56 as needed; replenishing a supply of staples 150 when necessary; and, benefiting from reduced time and effort required to accurately drive large numbers of staples 150 during a construction project or similar task, using the present apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A rolling staple gun for automatically applying a plurality of staples to a work surface while moving across the work surface, said rolling staple gun comprising:

a housing including a staple feed assembly and a staple driving assembly situated therein respectively, further comprising:

an access panel centrally located along a top surface of said housing;

a pair of rear wheels and a front wheel rotatable attached to said housing respectively;

a front bumper extending laterally across a forward-facing vertical surface of said housing for protecting said rolling staple gun from impact during movement;

a handle socket portion protruding from a rear central portion of said housing at an upward angle of approximately forty-five degrees relative to said work surface;

a control module;

a pitch selection potentiometer communicatively coupled to said control module, said pitch selection potentiometer defining a predetermined distance between consecutive staples to be driven into said work surface;

a rotary encoder affixed to one of said rear wheels and communicatively coupled to said control module, said rotary encoder detecting a distance traveled by said housing across said work surface; and, a power source communicatively coupled to said control module;

a handle assembly attached to said handle socket portion for maneuvering said housing across said work surface, said handle assembly including an electronic trigger for actuating said rolling staple gun; and, a plurality of staples engaged with said staple feed assembly;

wherein said staple driving assembly comprises:

a solenoid actuator communicatively coupled to said control module and having a driving shaft attached thereto;

a first tool attached to said driving shaft, said first tool having an angular forward face relative to said work surface;

a second tool having an angled upper face portion positioned at a right angle to said angular forward face of said first tool;

a bearing block attached to an underside surface of said housing;

a driver frame attached to a floor portion of said housing;

a spring return mechanism attached to said driver frame and said second tool; and, a staple aperture formed through said floor portion of said housing; and, wherein said staple feed assembly automatically feeds said staples to said staple driving assembly while said housing is maneuvered along the work surface.

2. The rolling staple gun of claim 1, wherein said solenoid shaft propels said first tool forward in a horizontal direction such that said first tool is guided along a horizontal plane via said bearing block which slidingly contacts a top surface of said first tool in a parallel manner;

wherein said angular forward face of first tool slidingly engages said second tool at a right angle to said first tool thereby converting a horizontal force of said first tool into a vertical force and thereby propelling said second tool downward;

wherein said second tool is guided and restrained in a vertical orientation by said driver frame and thereby drives a single staple downwardly through said staple aperture and into said work surface; and, wherein said spring return mechanism automatically returns said second tool to an upward position after said downward motion.

3. The rolling staple gun of claim 1, wherein said staple feed assembly further comprises:

a rail engaged with said staples and thereby slidably moving said staples inside said housing;

a slider slidably mated to said rail;

a spring housing pivotally secured at a rear portion of said rail; and, a coil spring secured to said slider and affixed to said spring housing respectively;

wherein said slider provides a static pushing force against said staples toward said staple driving assembly and thereby provides a horizontal motioning force to said slider and said staples via said coil spring.

4. The rolling staple gun of claim 3, wherein said staple feeding assembly provides linear horizontal spring-loaded movement of said staples along said rail portion.

5. A rolling staple gun for automatically applying a plurality of staples to a work surface while moving across the work surface, said rolling staple gun comprising:

a housing including a staple feed assembly and a staple driving assembly situated therein respectively, further comprising:

an access panel centrally located along a top surface of said housing;

a pair of rear wheels and a front wheel rotatable attached to said housing respectively;

a front bumper extending laterally across a forward-facing vertical surface of said housing for protecting said rolling staple gun from impact during movement;

a handle socket portion, said handle socket portion protruding from a rear central portion of said housing at an upward angle of approximately forty-five degrees relative to said work surface;

a control module;

a pitch selection potentiometer communicatively coupled to said control module, said pitch selection potentiometer defining a predetermined distance between consecutive staples to be driven into said work surface;

a rotary encoder affixed to one of said rear wheels and communicatively coupled to said control module, said rotary encoder detecting a distance traveled by said housing across said work surface; and, a power source communicatively coupled to said control module;

a handle assembly attached to said handle socket portion for maneuvering said housing across said work surface, said handle assembly including an electronic trigger for actuating said rolling staple gun; and, a plurality of staples engaged with said staple feed assembly;

wherein said staple driving assembly comprises:

a solenoid actuator communicatively coupled to said control module and having a driving shaft attached thereto;

a first tool attached to said driving shaft, said first tool having an angular forward face relative to said work surface;

a second tool having an angled upper face portion positioned at a right angle to said angular forward face of said first tool;

a bearing block attached to an underside surface of said housing;

a driver frame attached to a floor portion of said housing;

a spring return mechanism attached to said driver frame and said second tool; and, a staple aperture formed through said floor portion of said housing;

wherein said staple feed assembly automatically feeds said staples to said staple driving assembly while said housing is maneuvered along the work surface;

wherein said staple driving assembly dispenses said staples at desired repeating intervals while said housing is maneuvered along the work surface.

6. The rolling staple gun of claim 5, wherein said solenoid shaft propels said first tool forward in a horizontal direction such that said first tool is guided along a horizontal plane via said bearing block which slidingly contacts a top surface of said first tool in a parallel manner;

wherein said angular forward face of first tool slidingly engages said second tool at a right angle to said first tool thereby converting a horizontal force of said first tool into a vertical force and thereby propelling said second tool downward;

wherein said second tool is guided and restrained in a vertical orientation by said driver frame and thereby drives a single staple downwardly through said staple aperture and into said work surface; and, wherein said spring return mechanism automatically returns said second tool to an upward position after said downward motion.

7. The rolling staple gun of claim 6, wherein said staple feed assembly further comprises:

a rail engaged with said staples and thereby slidably moving said staples inside said housing;

a slider slidably mated to said rail;

a spring housing pivotally secured at a rear portion of said rail; and, a coil spring secured to said slider and affixed to said spring housing respectively;

wherein said slider provides a static pushing force against said staples toward said staple driving assembly and thereby provides a horizontal motioning force to said slider and said staples via said coil spring.

8. The rolling staple gun of claim 7, wherein said staple feeding assembly provides linear horizontal spring-loaded movement of said staples along said rail portion.

* * * * *